US005172488A

United States Patent [19]

Okane et al.

[11] Patent Number: 5,172,488

[45] Date of Patent: Dec. 22, 1992

[54] METHOD OF DRYING ELECTRONIC COMPONENTS

[75] Inventors: Masaaki Okane; Masataka Mae, both of Kyoto, Japan

[73] Assignee: Murata Manufacturing Co., Ltd., Japan

[21] Appl. No.: 751,552

[22] Filed: Aug. 29, 1991

[30] Foreign Application Priority Data

Sep. 5, 1990 [JP] Japan ..... 2-236666

[51] Int. Cl.[5] ..... F26B 5/04

[52] U.S. Cl. ..... 34/15; 34/92

[58] Field of Search ..... 34/15, 17, 92, 5, 11

[56] References Cited

U.S. PATENT DOCUMENTS 4,357,760 11/1982 Musschoot ..... 34/92

4,698,917 10/1987 Debolini ..... 34/92

*Primary Examiner*—Henry A. Bennett

*Assistant Examiner*—Denise L. F. Gromada

*Attorney, Agent, or Firm*—Ostrolenk, Faber, Gerb & Soffen

[57] ABSTRACT

A method of drying plurality of electronic components, which have been washed with water. The components are introduced into a drum-type container, and the container is decompressed and rotated about a horizontally directed central axis so as to stir the plurality of electronic components. The container may be at least partially dipped in a heated liquid bath, so that the container is heated by the liquid.

9 Claims, 1 Drawing Sheet

METHOD OF DRYING ELECTRONIC COMPONENTS

BACKGROUND OF THE INVENTION

1. Field of the Invention

The present invention relates to a method of drying electronic components which have been washed with water.

2. Description of the Background Art

In general, electronic components are washed with water in an intermediate or final stage of the manufacturing process steps. The electronic components thus washed with water must be then dried.

To this end, such electronic components are generally subjected to:

(1) substitutional drying with chlorofluorocarbon or alcohol; or (2) hot air drying or ventilation vacuum drying.

However, the aforementioned conventional drying methods have the following problems, which must be solved:

The first drying method (1) leads to environmental problems such as destruction of the ozonosphere when chlorofluorocarbon is employed, and there is a risk of fire when alcohol is employed.

In the second drying method (2), on the other hand, a plurality of electronic components tend to overlap and adhere to each other, particularly when the electronic components are in the form of thin plates. Thus, an extremely long time is required for drying the electronic components by simply applying hot air or placing them in a vacuum. In the case of ventilation vacuum drying, further, a long time is required for drying the electronic components, due to extremely inferior efficiency of heat transfer.

SUMMARY OF THE INVENTION

Accordingly, an object of the present invention is to provide a method of drying electronic components, which can solve the aforementioned problems.

The present invention is directed to a method of drying electronic components which have been washed with water. The inventive method comprises the steps of introducing a plurality of electronic components into a container, and rotating the container in order to stir the plurality of electronic components, while decompressing the container.

In the rotating step, the container is preferably heated.

According to the present invention, the container is so rotated as to stir the plurality of electronic components, whereby the electronic components will not remain overlapping or adhering to each other.

Thus, according to the present invention, the plurality of electronic components are stirred by rotation of the container and thus prevented from overlapping, so that they can be dried in a short time. Thus, the present invention is suitable for drying electronic components, which are in the form of thin plates, in particular.

Further, the present invention causes no problems such as an environmental problems or fire hazards since it is not necessary to use chlorofluorocarbon, alcohol or the like, unlike to the prior art.

When the container is heated in the present invention, it is possible to further reduce the drying time. According to the present invention, the container is decompressed and hence its efficiency of heat transfer is reduced. However, it is possible to compensate for such reduction of the efficiency of heat transfer by rotating the container and thereby stirring the electronic components. Thus, it is possible to uniformly heat a plurality of electronic components.

When electrodes are provided on the surfaces of the electronic components to be dried, the container is heated at a relatively low temperature, preferably within a range of 70° to 100° C., in order to prevent the electrodes from oxidation.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
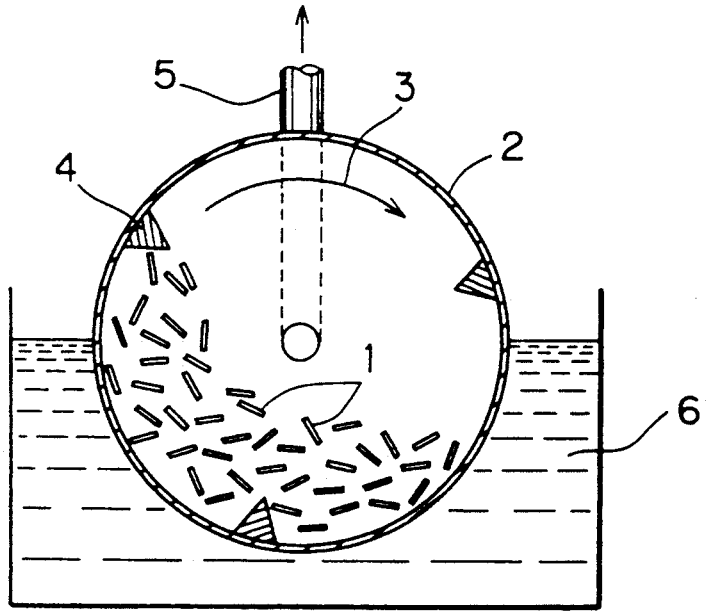
FIG. 1 is a sectional view showing a drying process according to an embodiment of the present invention.

FIG. 1 shows a plurality of electronic components 1 to be dried, which are in the form of thin plates. These electronic components 1 are introduced into a drum-type container 2.

The container 2 extends rotated about an axis which is along the horizontal direction, for example, as shown by an arrow 3. Thus, the plurality of electronic components 1 are stirred in the container 2. In order to facilitate this stirring action, baffles 4 may be arranged at a plurality of locations within the container 2.

A pressure reducing conduit 5 is connected to the container 2 to supply a negative pressure, thereby decompressing the container 2.

The container 2 rotated in the aforementioned manner is partially dipped in a liquid bath 6. The liquid bath 6 contains water, oil or the like, and is maintained at a temperature of 70° to 100° C., for example. Thus, the container 2 is heated, thereby heating the electronic components 1.

An experiment for drying electronic components was carried out according to the method shown in FIG. 1, under the following conditions:

Sample: 1000 electronic components 10 mm in diameter and 0.5 mm in thickness

Amount of Residual Water: 30 g

Degree of Vacuum: 5 mmHg

Container: drum type container of 250 mm in diameter, rotated at 1 r.p.m.

The electronic components were dried under the aforementioned conditions, whereby it was confirmed to be possible to dry the same in about 10 minutes.

A comparative experiment was carried out under the same conditions except that the container was not rotated. In this case, at least one hour was required for drying the electronic components.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of drying electronic components that have been exposed to water and are of a material that is not substantially damaged by stirring in a rotating container, comprising the steps of:

providing a container which is capable of storing a plurality of said electronic components;

introducing a plurality of said electronic components to be dried into said container; and rotating said container so as to stir said plurality of electronic components, while decompressing said container in which said plurality of electronic components are contained.

2. A method of drying electronic components in accordance with claim 1, wherein said step of rotating said container includes the step of heating said container.

3. A method of drying electronic components in accordance with claim 2, wherein said electronic components are provided with electrodes on the surfaces thereof, and said heating step is carried out at a limited temperature so as to prevent said electrodes from oxidizing.

4. A method of drying electronic components in accordance with claim 3, wherein said temperature is limited to a range of substantially 70° to 100° C.

5. A method of drying electronic components in accordance with claim 2, wherein said heating step includes the step of at least partially dipping said container in a heated liquid bath.

6. A method of drying electronic components in accordance with claim 1, wherein said container is in the form of a drum.

7. A method of drying electronic components in accordance with claim 6, wherein said container is rotated about a central axis and said central axis is substantially horizontal in said step of rotating said container.

8. A method of drying electronic components in accordance with claim 1, wherein said container comprises baffles for improving said stirring of said electronic components.

9. A method of drying electronic components in accordance with claim 6, wherein said container comprises baffles for improving said stirring of said electronic components.

* * * * *